US008473286B2

(12) United States Patent
Thyssen

(10) Patent No.: US 8,473,286 B2
(45) Date of Patent: Jun. 25, 2013

(54) NOISE FEEDBACK CODING SYSTEM AND METHOD FOR PROVIDING GENERALIZED NOISE SHAPING WITHIN A SIMPLE FILTER STRUCTURE

(75) Inventor: Jes Thyssen, Laguna Niguel, CA (US)

(73) Assignee: Broadcom Corporation, Irvine, CA (US)

( * ) Notice: Subject to any disclaimer, the term of this patent is extended or adjusted under 35 U.S.C. 154(b) by 2448 days.

(21) Appl. No.: 11/065,132

(22) Filed: Feb. 24, 2005

(65) Prior Publication Data

US 2005/0192800 A1 Sep. 1, 2005

Related U.S. Application Data

(60) Provisional application No. 60/547,535, filed on Feb. 26, 2004.

(51) Int. Cl.
*G10L 21/02* (2006.01)

(52) U.S. Cl.
USPC ..... 704/227; 84/661; 708/300; 704/230; 704/228; 704/226; 703/2; 700/53; 381/63; 381/312; 379/406.05; 375/232

(58) Field of Classification Search
USPC . 704/226, 230, 228; 84/661; 708/300; 703/2; 700/53; 381/63, 312; 379/406.05; 375/232
See application file for complete search history.

(56) References Cited

U.S. PATENT DOCUMENTS 2,927,962 A 3/1960 Cutler
4,220,819 A 9/1980 Atal
4,317,208 A 2/1982 Araseki et al.
4,677,668 A * 6/1987 Ardalan et al. ..... 379/406.05
4,776,015 A 10/1988 Takeda et al.
4,791,654 A 12/1988 De Marca et al.
4,811,396 A 3/1989 Yatsuzuka
4,860,355 A 8/1989 Copperi
4,896,361 A 1/1990 Gerson
4,918,729 A 4/1990 Kudoh
4,963,034 A 10/1990 Cuperman et al.
4,969,192 A 11/1990 Chen et al.
5,007,092 A 4/1991 Galand et al.
5,060,269 A 10/1991 Zinser
5,150,414 A * 9/1992 Ng ..... 704/226
5,195,168 A 3/1993 Yong (Continued)

FOREIGN PATENT DOCUMENTS

EP 0 573 216 A2 12/1993

OTHER PUBLICATIONS

Atal, B.S. and Schroeder, M.R., "Predictive Coding of Speech Signals and Subjective Error Criteria," *IEEE Transactions on Acoustics, Speech, and Signal Processing*, IEEE, vol. ASSP 27, No. 3, Jun. 1979, pp. 247-254.

(Continued)

*Primary Examiner* — Michael Colucci

(74) *Attorney, Agent, or Firm* — Sterne, Kessler, Goldstein & Fox P.L.L.C.

(57) ABSTRACT

A noise feedback coding (NFC) system and method that utilizes a simple and relatively inexpensive general structural configuration, but achieves improved flexibility with respect to controlling the shape of coding noise. The NFC system and method utilizes an all-zero noise feedback filter that is configured to approximate the response of a pole-zero noise feedback filter.

21 Claims, 5 Drawing Sheets

U.S. PATENT DOCUMENTS

| | | | | |
|---|---|---|---|---|
| 5,204,677 | A | 4/1993 | Akagiri et al. | |
| 5,206,884 | A | 4/1993 | Bhaskar | |
| 5,313,554 | A | 5/1994 | Ketchum | |
| 5,400,247 | A * | 3/1995 | He | 700/53 |
| 5,414,796 | A | 5/1995 | Jacobs et al. | |
| 5,432,883 | A | 7/1995 | Yoshihara | |
| 5,475,712 | A | 12/1995 | Sasaki | |
| 5,487,086 | A | 1/1996 | Bhaskar | |
| 5,493,296 | A | 2/1996 | Sugihara | |
| 5,615,298 | A * | 3/1997 | Chen | 704/228 |
| 5,651,091 | A | 7/1997 | Chen | |
| 5,675,702 | A | 10/1997 | Gerson et al. | |
| 5,710,863 | A | 1/1998 | Chen | |
| 5,734,789 | A | 3/1998 | Swaminathan et al. | |
| 5,745,871 | A | 4/1998 | Chen | |
| 5,790,759 | A | 8/1998 | Chen | |
| 5,826,224 | A | 10/1998 | Gerson et al. | |
| 5,828,996 | A | 10/1998 | Iijima et al. | |
| 5,862,233 | A * | 1/1999 | Poletti | 381/63 |
| 5,873,056 | A | 2/1999 | Liddy et al. | |
| 5,963,898 | A | 10/1999 | Navarro et al. | |
| 6,014,618 | A | 1/2000 | Patel et al. | |
| 6,055,496 | A | 4/2000 | Heidari et al. | |
| 6,104,992 | A | 8/2000 | Gao et al. | |
| 6,131,083 | A | 10/2000 | Miseki et al. | |
| 6,249,758 | B1 | 6/2001 | Mermelstein | |
| 6,284,965 | B1 * | 9/2001 | Smith et al. | 84/661 |
| 6,292,571 | B1 * | 9/2001 | Sjursen | 381/312 |
| 6,360,239 | B1 * | 3/2002 | Laroche | 708/300 |
| 6,944,219 | B2 * | 9/2005 | Mathe | 375/232 |
| 7,110,942 | B2 | 9/2006 | Thyssen et al. | |
| 7,171,355 | B1 | 1/2007 | Chen | |
| 7,206,740 | B2 | 4/2007 | Thyssen et al. | |
| 7,209,878 | B2 | 4/2007 | Chen | |
| 7,324,937 | B2 | 1/2008 | Thyssen et al. | |
| 2002/0055827 | A1 * | 5/2002 | Kyriakakis | 703/2 |
| 2002/0069052 | A1 * | 6/2002 | Chen | 704/230 |
| 2002/0072904 | A1 | 6/2002 | Chen | |
| 2003/0083865 | A1 | 5/2003 | Thyssen | |
| 2003/0088406 | A1 | 5/2003 | Chen et al. | |
| 2005/0091046 | A1 | 4/2005 | Thyssen et al. | |

OTHER PUBLICATIONS

Gerson, I.A. and Jasiuk, M.A., "Techniques for Improving the Performance of CELP-Type Speech Coders," *IEEE Journal on Selected Areas in Communications*, IEEE, vol. 10, No. 5, Jun. 1992, pp. 858-865.

Hayashi, S. et al., "Low Bit-Rate CELP Speech Coder with Low Delay," *Signal Processing*, Elsevier Science B.V., vol. 72, 1999, pp. 97-105.

Kimme, E.G. and Kuo, F.F., "Synthesis of Optimal Filters for a Feedback Quantization System*," *IEEE Transactions on Circuit Theory*, The Institute of Electrical and Electronics Engineers, Inc., vol. CT 10, No. 3, Sep. 1963, pp. 405-413.

Lee, C.C., "An Enhanced ADPCM Coder for Voice Over Packet Networks," *International Journal of Speech Technology*, Kluwer Academic Publishers, 1999, pp. 343-357.

Makhoul, J. and Berouti, M., "Adaptive Noise Spectral Shaping and Entropy Coding in Predictive Coding of Speech," *IEEE Transactions on Acoustics, Speech, and Signal Processing*, IEEE, vol. ASSP 27, No. 1, Feb. 1979, pp. 63-73.

Marcellin, M.W, et al., "Predictive Trellis Coded Quantization of Speech," *IEEE Transactions on Acoustics, Speech, and Signal Processing*, IEEE, vol. 38, No. 1, Jan. 1990, pp. 46-55.

Marcellin, M.W. and Fischer, T.R., "A Trellis-Searched 16 KBIT/SEC Speech Coder with Low-Delay," *Proceedings of the Workshop on Speech Coding for Telecommunications*, Kluwer Publishers, 1989, pp. 47-56.

Tokuda, K. et al., "Speech Coding Based on Adaptive Mel-Cepstral Analysis," IEEE, 1994, pp. I-197 thru I-200.

Watts, L. and Cuperman, V., "A Vector ADPCM Analysis-By-Synthesis Configuration for 16 kbit/s Speech Coding," *Proceedings of the Global Telecommunications Conference and Exhibiton* (*Globecom*), IEEE, 1988, pp. 275-279.

* cited by examiner

FIG. 1 Conventional Noise Feedback Coding

FIG. 2 An alternative form of conventional Noise Feedback Coding

NOISE FEEDBACK CODING SYSTEM AND METHOD FOR PROVIDING GENERALIZED NOISE SHAPING WITHIN A SIMPLE FILTER STRUCTURE

CROSS-REFERENCE TO RELATED APPLICATIONS

This application claims the benefit of U.S. provisional patent application No. 60/547,535 entitled "Method and System for Providing Generalized Noise Shaping within a Simple Filter Structure", filed on Feb. 26, 2004, the entirety of which is incorporated by reference as if fully set forth herein.

BACKGROUND OF THE INVENTION

1. Field of the Invention

This invention relates generally to digital communications, and more particularly, to the coding and decoding of speech or other audio signals in a digital communications system.

2. Related Art

In speech or audio coding, a coder encodes an input speech or audio signal into a digital bit stream for transmission or storage, and a decoder decodes the bit stream into an output speech or audio signal. The combination of the coder and the decoder is called a codec.

In the field of speech coding, a popular encoding method is predictive coding. Rather than directly encoding the speech signal samples into a bit stream, a predictive encoder predicts the current input speech sample from previous speech samples, subtracts the predicted value from the input sample value, and then encodes the difference, or prediction residual, into a bit stream. The decoder decodes the bit stream into a quantized version of the prediction residual, and then adds the predicted value back to the residual to reconstruct the speech signal. This encoding principle is called Differential Pulse Code Modulation, or DPCM.

In conventional DPCM codecs, the coding noise, or the difference between the input signal and the reconstructed signal at the output of the decoder, is white. In other words, the coding noise has a flat spectrum. Since the spectral envelope of voiced speech slopes down with increasing frequency, such a flat noise spectrum means the coding noise power often exceeds the speech power at high frequencies. When this happens, the coding distortion is perceived as a hissing noise, and the decoder output speech sounds noisy. Thus, white coding noise is not optimal in terms of perceptual quality of output speech.

The perceptual quality of coded speech can be improved by adaptive noise spectral shaping, in which the spectrum of the coding noise is adaptively shaped so that it follows the input speech spectrum to some extent. In effect, this makes the coding noise more speech-like. Due to the noise masking effect of human hearing, such shaped noise is less audible to human ears. Therefore, codecs employing adaptive noise spectral shaping provide better output quality than codecs that produce white coding noise.

In recent and popular predictive speech coding techniques such as Multi-Pulse Linear Predictive Coding (MPLPC) or Code-Excited Linear Prediction (CELP), adaptive noise spectral shaping is achieved by using a perceptual weighting filter to filter the coding noise and then calculating the mean-squared error (MSE) of the filter output in a closed-loop codebook search. However, an alternative method for adaptive noise spectral shaping, known as Noise Feedback Coding (NFC), had been proposed more than two decades before MPLPC or CELP came into existence.

The basic ideas of NFC date back to the work of C. C. Cutler as described in U.S. Pat. No. 2,927,962, issued Mar. 8, 1960 and entitled "Transmission Systems Employing Quantization". Based on Cutler's ideas, E. G. Kimme and F. F. Kuo proposed a noise feedback coding system for television signals in their paper "Synthesis of Optimal Filters for a Feedback Quantization System," *IEEE Transactions on Circuit Theory*, pp. 405-413, September 1963. Enhanced versions of NFC, applied to Adaptive Predictive Coding (APC) of speech, were later proposed by J. D. Makhoul and M. Berouti in "Adaptive Noise Spectral Shaping and Entropy Coding in Predictive Coding of Speech," *IEEE Transactions on Acoustics, Speech, and Signal Processing*, pp. 63-73, February 1979, and by B. S. Atal and M. R. Schroeder in "Predictive Coding of Speech Signals and Subjective Error Criteria," *IEEE Transactions on Acoustics, Speech, and Signal Processing*, pp. 247-254, June 1979. Such codecs are sometimes referred to as APC-NFC. More recently, NFC has also been used to enhance the output quality of Adaptive Differential Pulse Code Modulation (ADPCM) codecs, as proposed by C. C. Lee in "An enhanced ADPCM Coder for Voice Over Packet Networks," *International Journal of Speech Technology*, pp. 343-357, May 1999.

In noise feedback coding, the difference signal between the quantizer input and output is passed through a filter, whose output is then added to the prediction residual to form the quantizer input signal. By carefully choosing the filter in the noise feedback path (called the noise feedback filter), the spectrum of the overall coding noise can be shaped to make the coding noise less audible to human ears. Initially, NFC was used in codecs with only a short-term predictor that predicts the current input signal samples based on the adjacent samples in the immediate past. Examples of such codecs include the systems proposed by Makhoul and Berouti in their 1979 paper. The noise feedback filters used in such early systems are short-term filters. As a result, the corresponding adaptive noise shaping only affects the spectral envelope of the noise spectrum.

In addition to the short-term predictor, Atal and Schroeder added a three-tap long-term predictor in the APC-NFC codecs proposed in their 1979 paper cited above. Such a long-term predictor predicts the current sample from samples that are roughly one pitch period earlier. For this reason, it is sometimes referred to as the pitch predictor in the speech coding literature. While the short-term predictor removes the signal redundancy between adjacent samples, the pitch predictor removes the signal redundancy between distant samples due to the pitch periodicity in voiced speech. Thus, the addition of the pitch predictor further enhances the overall coding efficiency of the APC systems.

The basic structure of a conventional NFC codec 100 is illustrated in FIG. 1. As shown in that figure, an encoder portion of codec 100 includes a first predictor 102, a first combiner 104, and a quantizer portion 106. Quantizer portion 106 includes a quantizer 110, a second combiner 108, a third combiner 112, and a noise feedback filter 114. A decoder portion of codec 100 includes a fourth combiner 116 and a second predictor 118.

The encoder portion of codec 100 encodes a sampled input speech signal s(n) to produce a quantizer output signal û(n). In particular, input speech signal s(n) is received by first predictor 102 and first combiner 104. First predictor 102 predicts input speech signal s(n) to produce a predicted speech signal. The predicted speech signal is then subtracted from s(n) at combiner 104 to produce a prediction residual signal d(n).

Within quantizer portion 106, second combiner 108 receives prediction residual signal d(n) and combines it with a noise feedback signal from noise feedback filter 114 to produce a quantizer input signal u(n). Quantizer 110 quantizes input signal u(n) to produce quantizer output signal $\hat{u}(n)$. Third combiner 112 combines, or differences, signals u(n) and $\hat{u}(n)$ to produce a quantization error signal q(n). Noise feedback filter 114 filters quantization error signal q(n) to produce the previously-described noise feedback signal.

The decoder portion of codec 100 receives quantizer output signal $\hat{u}(n)$ and decodes it to produce reconstructed speech signal $\hat{s}(n)$. In particular, fourth combiner 116 combines quantizer output signal $\hat{u}(n)$ with a predicted reconstructed speech signal provided by second predictor 118 to produce reconstructed speech signal $\hat{s}(n)$. Second predictor 118 predicts the reconstructed speech signal based on past samples of $\hat{s}(n)$.

Due to the configuration of codec 100, the final shape of the coding noise is determined by predictor 102 and noise feedback filter 114. Predictors 102 and 118 are each designed to optimally predict input speech or audio signal s(n) and have an identical transfer function of $$\hat{P}(z) = \sum_{i=1}^{M} \hat{\alpha}_i z^{-i}, \tag{1}$$

where M is the predictor order and $\hat{\alpha}_i$ is the i-th predictor coefficient. As used herein, the nomenclature $\hat{P}(z)$ and $\alpha_i$ is intended to indicate the use of quantized predictor coefficients, while P(z) and $\alpha_i$ indicate the use of non-quantized predictor coefficients.

The noise feedback filter F(z) can have many possible forms. One popular form of F(z) is functionally related to the predictor $\hat{P}(z)$ as described in equation (1) and is given by $$F(z) = \sum_{i=1}^{L} f_i z^{-i}, \tag{2}$$

wherein L is the filter order and $f_i$ is the i-th filter coefficient, and wherein L=M and $f_i=\delta^i\hat{\alpha}_i$, or $F(z)=\hat{P}(z/\delta)$. The variable δ denotes a filter control parameter. Given the NFC codec structure in FIG. 1, and using F(z) as defined above, the final shape of the coding noise may be expressed as $$W_1(z) = \frac{1 - F(z)}{1 - \hat{P}(z)} = \frac{\hat{A}(z/\delta)}{\hat{A}(z)}, \tag{3}$$

where $$\hat{A}(z) = 1 - \hat{P}(z) = \sum_{i=0}^{M} \hat{a}_i z^{-i},$$

in which $\hat{\alpha}_0=1$, $\hat{\alpha}_i=-\alpha_i$, i=1, . . . , M. It has been found in some implementations that using an eighth order predictor and noise feedback filter (L=M=8) and setting δ=0.75 produces satisfactory results in terms of masking coding noise.

From the standpoint of cost and complexity, NFC codec 100 is relatively simple to implement due to its structure and also because it utilizes an all-zero noise feedback filter. However, codec 100 provides limited flexibility for controlling final noise shape due to the way in which the all-zero noise feedback filter must be specified. In other words, because the denominator of $W_1(z)$ is fixed and wholly dependent on the design of input predictor $\hat{P}(z)$, the degree to which final noise shaping can be controlled is somewhat limited.

FIG. 2 shows the structure of an alternative NFC codec 200 for conventional noise feedback coding. Makhoul and Berouti proposed this structure in their 1979 paper cited above. As shown in FIG. 2, codec 200 comprises a quantizer portion 202 that encompasses both encoder and decoder functions. Quantizer portion 202 includes a first combiner 204, a second combiner 208, a third combiner 210, a fourth combiner 216, a quantizer 206, a predictor 212, and a noise feedback filter 214.

Codec 200 operates as follows. An input speech signal s(n) is received by first combiner 204, which combines s(n) with a feedback signal to generate a quantizer input signal u(n). Quantizer 206 quantizes input signal u(n) to produce quantizer output signal $\hat{u}(n)$. Second combiner 208 combines, or differences, signals u(n) and $\hat{u}(n)$ to produce a quantization error signal q(n). Noise feedback filter 214 filters quantization error signal q(n) to produce a noise feedback signal which is provided to fourth combiner 216.

Quantizer output signal $\hat{u}(n)$ is received by third combiner 210 which combines $\hat{u}(n)$ with a predicted reconstructed speech signal output by predictor 212 to produce a reconstructed speech signal $\hat{s}(n)$. Predictor 212 predicts the reconstructed speech signal based on past samples of $\hat{s}(n)$. The output of predictor 212 is also received by fourth combiner 216, which combines it with the noise feedback signal output by noise feedback filter 214 to produce the previously-described feedback signal received by first combiner 204.

Due to the configuration of codec 200, the final shape of the coding noise is determined entirely by N(z). Thus, more flexibility is permitted in controlling the coding noise as compared to codec 100, in which noise shaping is dictated in part by the input predictor $\hat{P}(z)$. In practice, it has been observed that a desirable noise shape is achieved with codec 200 by defining N(z) with reference to predictor 212 such that the spectral shape of the coding noise is given by $$W_2(z) = N(z) = \frac{A(z/\delta_1)}{A(z/\delta_2)}, \tag{4}$$

wherein $A(z/\delta_1)=1-P(z/\delta_1)$ and $A(z/\delta_2)=1-P(z/\delta_2)$. The variables $\delta_1$ and $\delta_2$ denote filter control parameters. Setting $\delta_1=0.5$ and $\delta_2=0.85$ has produced good noise masking results in some implementations. Note that because N(z) can be specified freely, non-quantized predictor coefficients can be used to implement noise feedback filter 212, whereas noise feedback filter 114 of codec 100 should be implemented using quantized predictor coefficients.

The alternative NFC codec 200 of FIG. 2 provides much greater flexibility for controlling the shaping of coding noise as compared to structure 100 of FIG. 1 because the designer can control both the numerator and denominator of $W_2(z)$. However, the cost and complexity of this alternative approach is relatively high as compared to structure 100 because, in part, the noise feedback filter is a pole-zero filter.

What is desired therefore is a technique for combining the benefits of the foregoing NFC implementations. More specifically, what is desired is an NFC implementation that provides the flexibility of codec 200 with respect to controlling the shape of coding noise but nevertheless utilizes the simpler and less costly configuration of codec 100.

SUMMARY OF THE INVENTION

A noise feedback coding implementation in accordance with an embodiment of the present invention utilizes the simple and relatively inexpensive general structural configuration of codec 100, but achieves the flexibility of codec 200 with respect to controlling the shape of coding noise. This is achieved by using an all-zero noise feedback filter that is configured to approximate the response of a pole-zero noise feedback filter.

In particular, an encoder in accordance with an embodiment of the present invention includes first, second and third combiners, a quantizer and a noise feedback filter. The first combiner combines an input speech signal and a predicted speech signal to generate a prediction residual signal. The second combiner combines the prediction residual signal with a noise feedback signal to generate a quantizer input signal. The quantizer, which may comprise a vector quantizer, quantizes the quantizer input signal to generate a quantizer output signal. The third combiner combines the quantizer input signal and the quantizer output signal to generate a quantization error signal. The noise feedback filter filters the quantization error signal to generate the noise feedback signal. The noise feedback filter is an all-zero filter configured to approximate the response of a pole-zero noise feedback filter. The response of the noise feedback filter may be defined as a truncated finite impulse response of a pole-zero filter.

In an embodiment, the encoder further includes a predictor that receives the input speech signal and generates the predicted speech signal therefrom. The predictor may comprise a short-term predictor. In a further embodiment, $\hat{P}(z)$ is a transfer function of the predictor based on quantized predictor coefficients, $P(z)$ is a transfer function of the predictor based on non-quantized predictor coefficients, and the response of the noise feedback filter is defined as a finite impulse response truncation of $F(z)$, wherein $$F(z) = 1 - \frac{\hat{A}(z)A(z/\delta_1)}{A(z/\delta_2)},$$

$\hat{A}(z)=1-\hat{P}(z)$, $A(z)=1-P(z)$, and $\delta_1$ and $\delta_2$ are filter control parameters.

Further features and advantages of the invention, as well as the structure and operation of various embodiments of the invention, are described in detail below with reference to the accompanying drawings. It is noted that the invention is not limited to the specific embodiments described herein. Such embodiments are presented herein for illustrative purposes only. Additional embodiments will be apparent to persons skilled in the relevant art(s) based on the teachings contained herein.

BRIEF DESCRIPTION OF THE DRAWINGS

The accompanying drawings, which are incorporated herein and form part of the specification, illustrate the present invention and, together with the description, further serve to explain the principles of the invention and to enable a person skilled in the art to make and use the invention.

Figure 1:
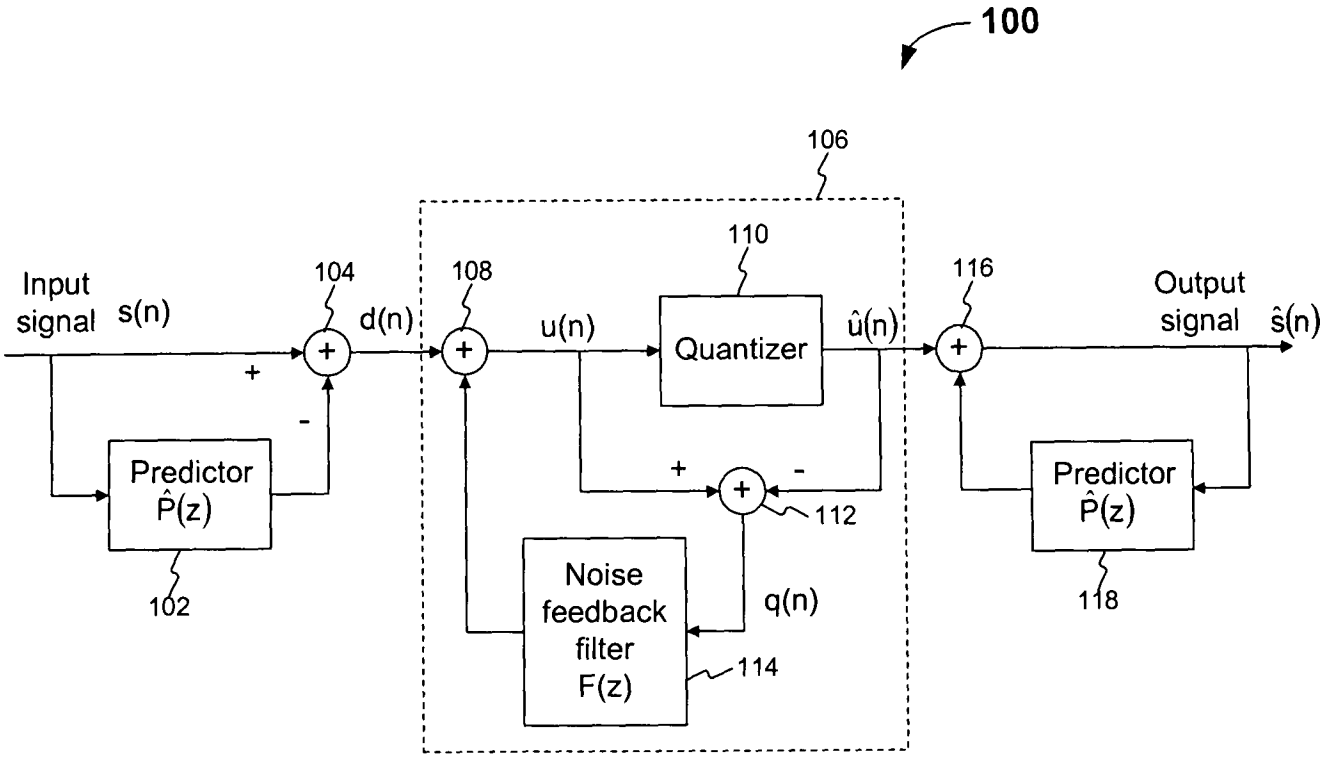
FIG. 1 is a block diagram illustrating the structure of a first conventional noise feedback coding (NFC) codec.

The features and advantages of the present invention will become more apparent from the detailed description set forth below when taken in conjunction with the drawings, in which like reference characters identify corresponding elements throughout. In the drawings, like reference numbers generally indicate identical, functionally similar, and/or structurally similar elements. The drawing in which an element first appears is indicated by the leftmost digit(s) in the corresponding reference number.

DETAILED DESCRIPTION OF THE INVENTION

Figure 3:
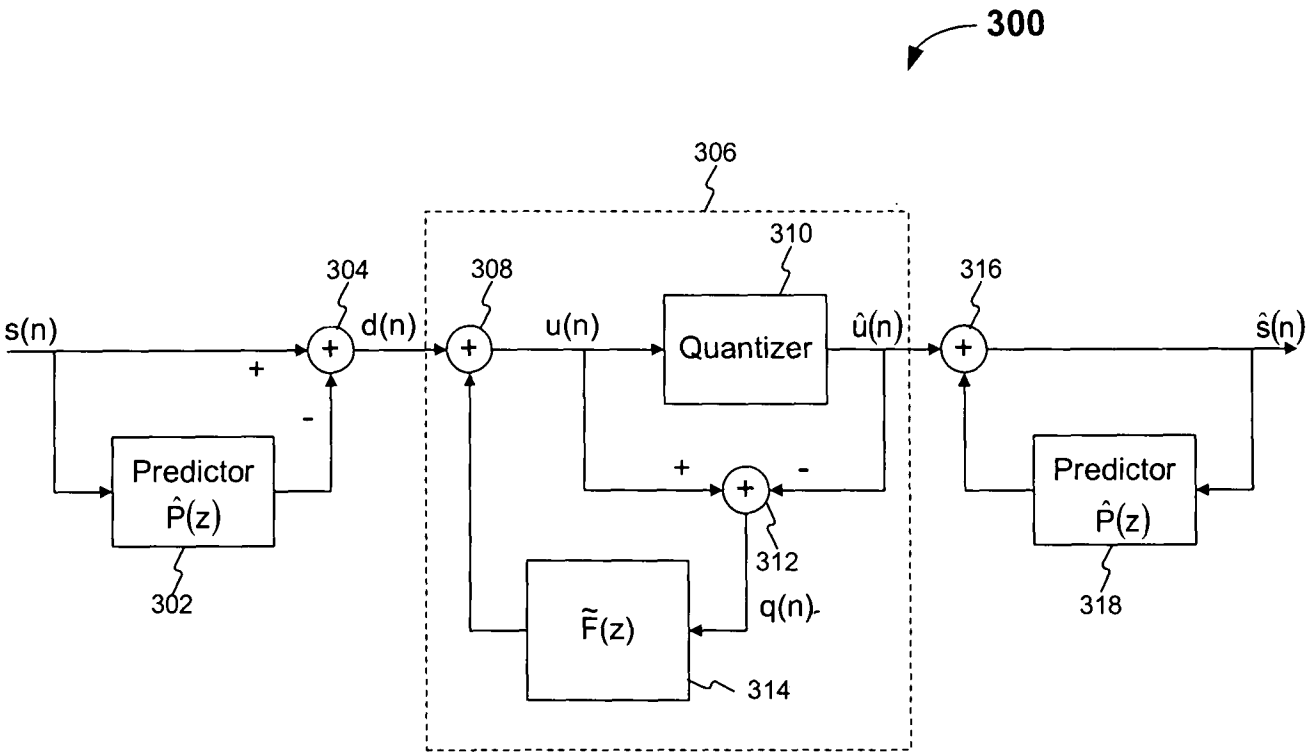
FIG. 3 is a block diagram illustrating the structure of an NFC codec in accordance with an embodiment of the present invention.

FIG. 3 is a block diagram illustrating the structure of a noise feedback coding (NFC) codec 300 in accordance with an exemplary embodiment of the present invention. An encoder portion of codec 300 includes a first predictor 302, a first combiner 304, and a quantizer portion 306. Quantizer portion 306 includes a quantizer 310, a second combiner 308, a third combiner 312, and a noise feedback filter 314. A decoder portion of codec 300 includes a fourth combiner 316 and a second predictor 318.

As is apparent from FIG. 3, codec 300 has the same basic structure as conventional NFC codec 100 described in the background section above. However, in codec 300, noise feedback filter $F(z)$ has been replaced with a new noise feedback filter $\tilde{F}(z)$. Like $F(z)$, noise feedback filter $\tilde{F}(z)$ is an all-zero filter; however, it provides improved flexibility and control of the shaping of coding noise. The derivation of $\tilde{F}(z)$ will now be described.

A. Derivation of Noise Feedback Filter $\tilde{F}(Z)$

Figure 2:
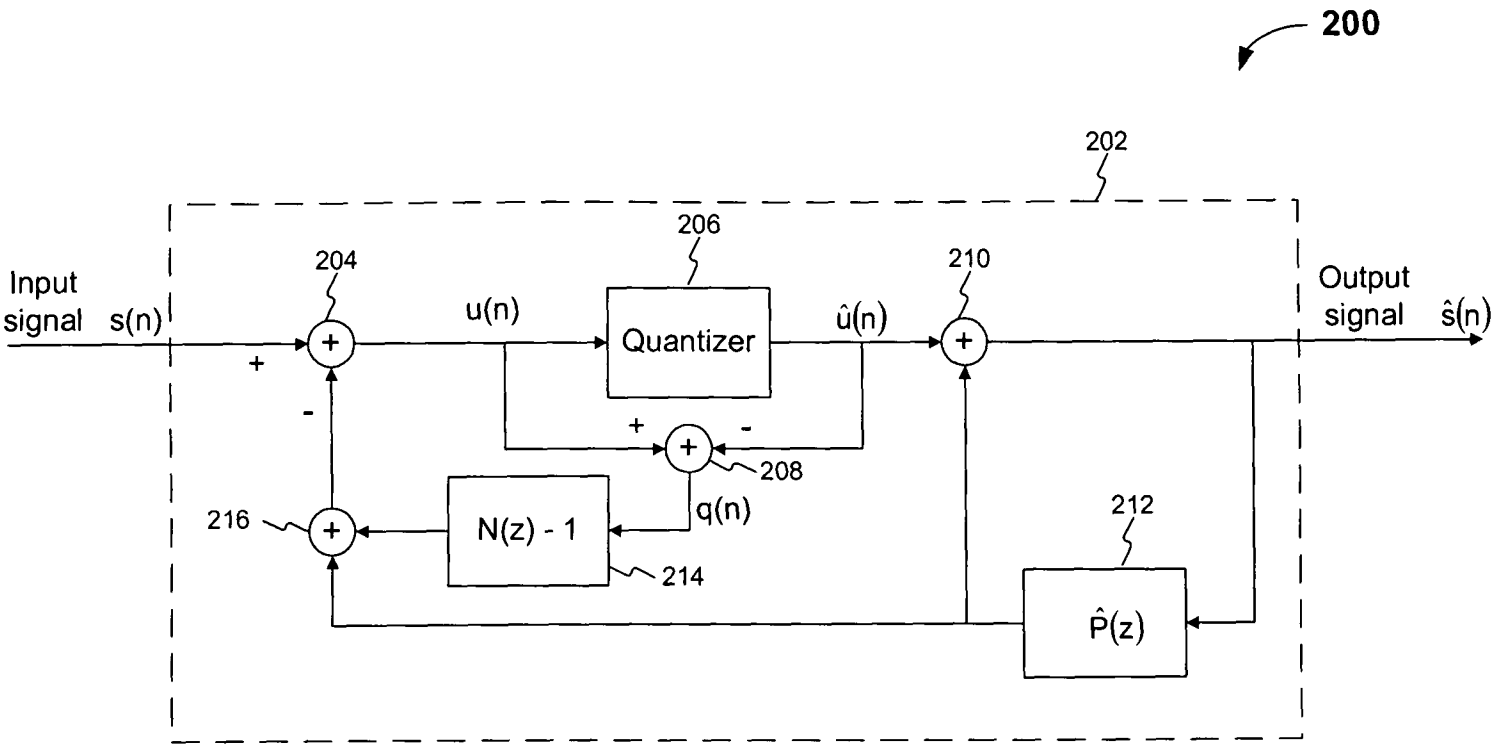
FIG. 2 is a block diagram illustrating the structure of a second conventional NFC codec.

It is desired that embodiments of the present invention achieve substantially the same result with respect to the flexible shaping of coding noise as codec 200 of FIG. 2, while using the same overall structure as codec 100 of FIG. 1, including the use of an all-zero noise feedback filter instead of a pole-zero noise feedback filter. In mathematical terms, then, it is desired that the noise shape provided by codec 100 of FIG. 1 be equal to the noise shape provided by codec 200 of FIG. 2, or $$W_1(z)=W_2(z). \tag{5}$$

where $W_1(z)$ and $W_2(z)$ are respectively given by equations (3) and (4) above. In other words:

$$\frac{\hat{A}(z/\delta)}{\hat{A}(z)} = \frac{A(z/\delta_1)}{A(z/\delta_2)}.$$

Solving this equation for $\hat{A}(z/\delta)$ gives:

$$\hat{A}(z/\delta) = \frac{\hat{A}(z)A(z/\delta_1)}{A(z/\delta_2)},$$

or, equivalently:

$$1 - F(z) = \frac{\hat{A}(z)A(z/\delta_1)}{A(z/\delta_2)}$$

By solving this equation for F(z), it can be seen that $$F(z) = 1 - \frac{\hat{A}(z)A(z/\delta_1)}{A(z/\delta_2)} \tag{6}$$

Thus, F(z) as set forth in equation (6) has a pole section and a zero section. However, as noted above, it is desired that the noise feedback filter be implemented as an all-zero filter.

In accordance with an embodiment of the present invention, the complicated pole-zero filter of equation (6) is approximated using an all-zero filter. This is achieved by determining the impulse response of the pole-zero filter of equation (6). However, because the impulse response of a pole-zero filter is infinite, the result is truncated at a point that provides a reasonable trade off between filter complexity and noise shaping control. In mathematical terms, then F(z) is approximated using a $K^{th}$ order finite impulse response (FIR) truncation of F(z), denoted $\tilde{F}(z)$:

$$\tilde{F}(z) = \sum_{i=1}^{K} f_i z^{-1}, \tag{7}$$

wherein K is the filter order and $f_i$ is the i-th filter coefficient.

In order to achieve this, an impulse must be passed through the filter F(z). This is carried out as follows. First, the combined response of the numerator portion of the second half of equation (6), $\hat{A}(z)A(z/\delta_1)$, is determined in accordance with the equation:

$$\{p_i\} = \{\hat{a}_i\} * \{a_i \delta_1^{\,i}\}, i = 0, 1, \ldots, K, \tag{8}$$

where the "*" denotes convolution. Note that multiplication in the z domain corresponds to convolution in the time domain. The result of equation (8) can be calculated as follows:

$$p_i = \sum_{k=0}^{\mathrm{Min}\{i,M\}} (a_k \delta_1^k) \cdot \hat{a}_{i-k}, \quad i = 0, 1, \ldots, K, \tag{9}$$

wherein M is the order of the predictor $\hat{P}(z)$. The denominator portion of the second half of equation (6) is then accounted for as follows to determine the impulse response of the entire second half of equation (6):

$$q_i = p_i - \sum_{k=1}^{\mathrm{Min}\{i,M\}} (a_k \delta_2^k) \cdot q_{i-k}, \quad i = 0, 1, \ldots, K. \tag{10}$$

Finally, based on equation (10), the filter coefficients for $\tilde{F}(z)$ can be expressed as:

$$f_i = \begin{cases} 0 & i = 0 \\ -q_i & i = 1, \ldots, K^*. \end{cases} \tag{11}$$

In practice, it has been determined that for an implementation in which the predictor $\hat{P}(z)$ is an eight order predictor (and thus A(z) and $\hat{A}(z)$ are eighth order), a twelfth order filter $\tilde{F}(z)$ provides a good trade off between filter complexity and noise shaping control.

Figure 4:
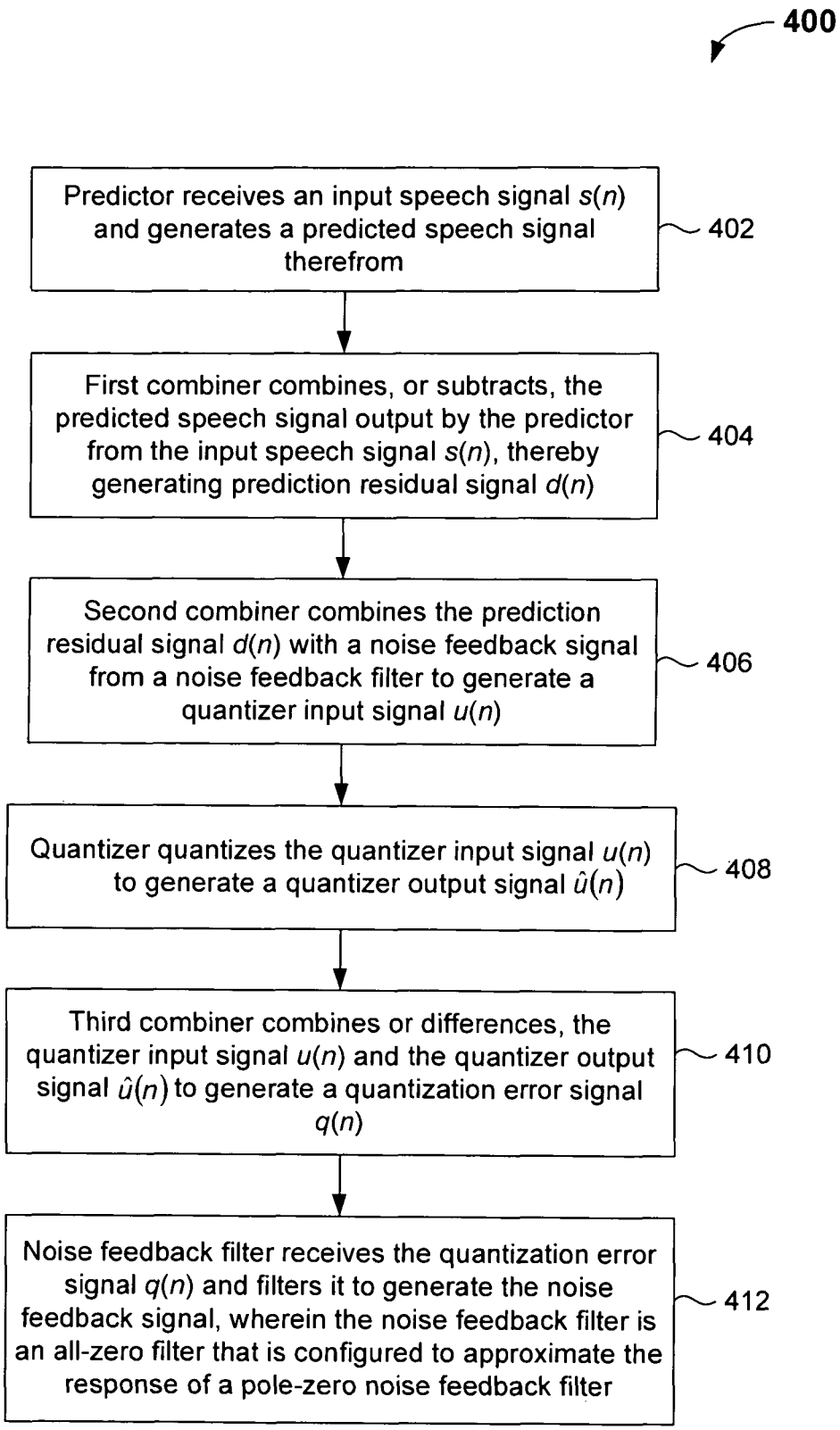
FIG. 4 is a flowchart of a method for encoding an input speech signal in an NFC codec in accordance with an embodiment of the present invention.

B. Operation of NFC Encoder in Accordance with an Embodiment of the Present Invention The manner in which codec 300 operates to encode an input speech signal will now be described with reference to flowchart 400 of FIG. 4. The method begins at step 402, in which predictor 302 receives input speech signal s(n) and generates a predicted speech signal therefrom. In an embodiment, predictor 302 is a short-term predictor having a transfer function $\hat{P}(z)$ based on quantized predictor coefficients (where non-quantized predictor coefficients are used, the transfer function is denoted P(z)).

At step 404, first combiner 304 combines, or subtracts, the predicted speech signal output by predictor 302 from the input speech signal s(n), thereby generating prediction residual signal d(n). At step 406, second combiner 308 combines the prediction residual signal d(n) with a noise feedback signal from a noise feedback filter 314 to generate a quantizer input signal u(n). At step 408, quantizer 310 quantizes the quantizer input signal u(n) to generate a quantizer output signal $\hat{u}(n)$. As will be appreciated by persons skilled in the relevant art, quantizer 310 may comprise, for example, a scalar quantizer that quantizes one sample at a time or a vector quantizer that quantizes groups of samples at a time.

At step 410, third combiner 312 combines the quantizer input signal u(n) and the quantizer output signal $\hat{u}(n)$ to generate a quantization error signal q(n). At step 412, noise feedback filter 314 receives the quantization error signal q(n) and filters it to generate the noise feedback signal. As noted above, the noise feedback filter 314 is an all-zero filter $\tilde{F}(z)$ that is configured to approximate the response of a pole-zero noise feedback filter and thereby provides better and more flexible control over the shaping of coding noise. As set forth in Section B above, in a particular embodiment, the response of noise feedback filter 314 is defined as a finite impulse response truncation of F(z), wherein $$F(z) = 1 - \frac{\hat{A}(z)A(z/\delta_1)}{A(z/\delta_2)},$$

$\hat{A}(z) = 1 - \hat{P}(z)$, $A(z) = 1 - P(z)$, and $\delta_1$ and $\delta_2$ are filter control parameters. A manner of determining the filter coefficients $f_i$ for $\tilde{F}(z)$ is also set forth in equations (8), (9) and (10) in Section B above.

It should be noted that the present invention is not limited to the NFC codec structure 300 shown in FIG. 3, but also encompasses other NFC codec structures that include additional elements beyond those shown in FIG. 3. For example, commonly owned co-pending U.S. patent application Ser. No. 09/722,077, entitled "Method and Apparatus for One-Stage and Two-Stage Noise Feedback Coding of Speech and Audio Signals" to Chen, filed Nov. 27, 2000 (the entirety of which is incorporated by reference as if fully set forth herein), discloses several novel NFC codec structures that include the basic structural elements shown in FIG. 3 in addition to other nested elements. A person skilled in the relevant art will readily appreciate that the present invention is also applicable to such novel codec structures.

C. Hardware and Software Implementations

Figure 5:
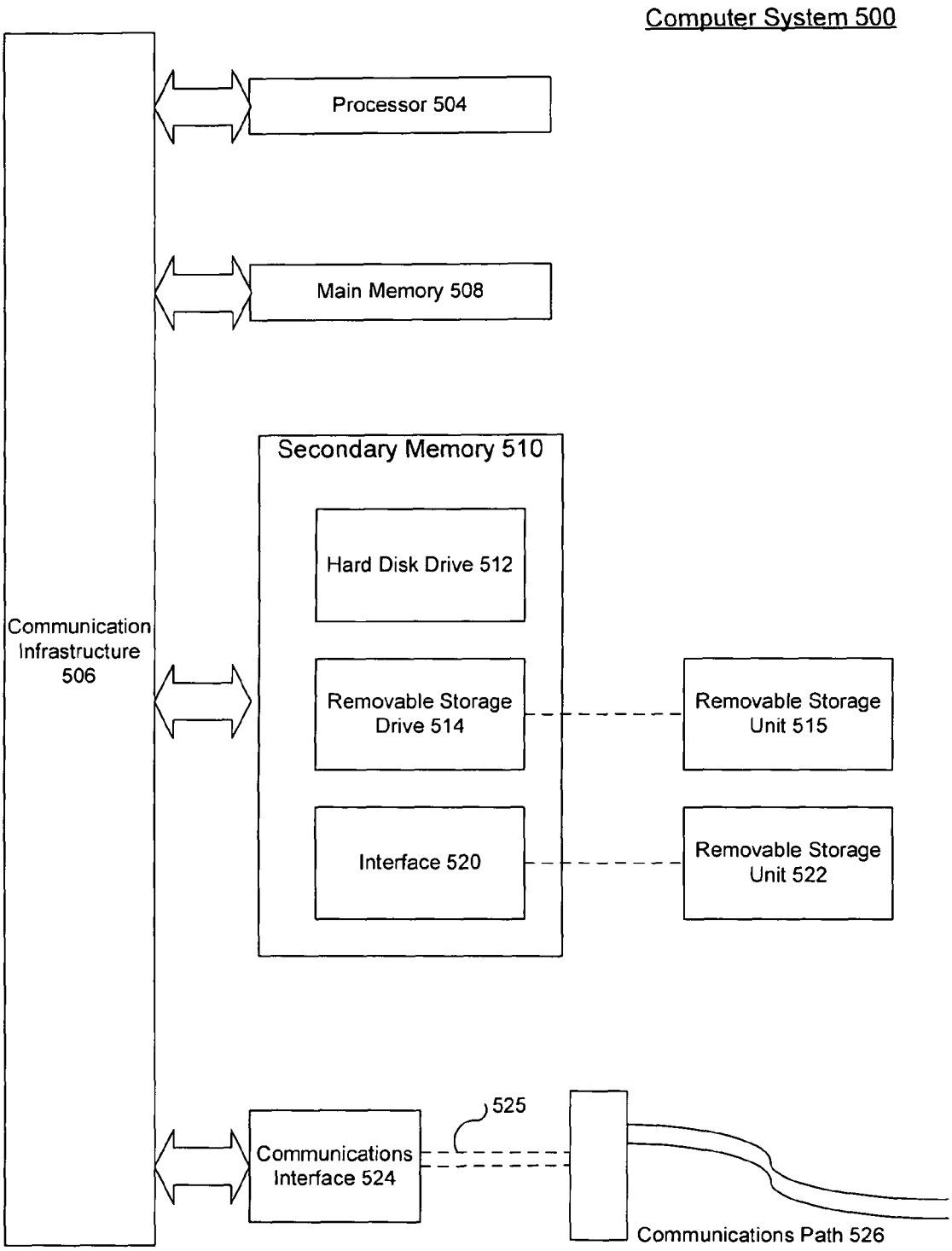
FIG. 5 is a block diagram of a computer system on which an embodiment of the present invention may operate.

The following description of a general purpose computer system is provided for completeness. The present invention can be implemented in hardware, or as a combination of software and hardware. Consequently, the invention may be implemented in the environment of a computer system or other processing system. An example of such a computer system 500 is shown in FIG. 5. In the present invention, all of the signal processing blocks depicted in FIG. 3, for example, can execute on one or more distinct computer systems 500, to implement the various methods of the present invention. The computer system 500 includes one or more processors, such as processor 504. Processor 504 can be a special purpose or a general purpose digital signal processor. The processor 504 is connected to a communication infrastructure 506 (for example, a bus or network). Various software implementations are described in terms of this exemplary computer system. After reading this description, it will become apparent to a person skilled in the art how to implement the invention using other computer systems and/or computer architectures.

Computer system 500 also includes a main memory 505, preferably random access memory (RAM), and may also include a secondary memory 510. The secondary memory 510 may include, for example, a hard disk drive 512 and/or a removable storage drive 514, representing a floppy disk drive, a magnetic tape drive, an optical disk drive, etc. The removable storage drive 514 reads from and/or writes to a removable storage unit 515 in a well known manner. Removable storage unit 515, represents a floppy disk, magnetic tape, optical disk, etc. which is read by and written to by removable storage drive 514. As will be appreciated, the removable storage unit 515 includes a computer usable storage medium having stored therein computer software and/or data.

In alternative implementations, secondary memory 510 may include other similar means for allowing computer programs or other instructions to be loaded into computer system 500. Such means may include, for example, a removable storage unit 522 and an interface 520. Examples of such means may include a program cartridge and cartridge interface (such as that found in video game devices), a removable memory chip (such as an EPROM, or PROM) and associated socket, and other removable storage units 522 and interfaces 520 which allow software and data to be transferred from the removable storage unit 522 to computer system 500.

Computer system 500 may also include a communications interface 524. Communications interface 524 allows software and data to be transferred between computer system 500 and external devices. Examples of communications interface 524 may include a modem, a network interface (such as an Ethernet card), a communications port, a PCMCIA slot and card, etc. Software and data transferred via communications interface 524 are in the form of signals 525 which may be electronic, electromagnetic, optical or other signals capable of being received by communications interface 524. These signals 525 are provided to communications interface 524 via a communications path 526. Communications path 526 carries signals 525 and may be implemented using wire or cable, fiber optics, a phone line, a cellular phone link, an RF link and other communications channels. Examples of signals that may be transferred over interface 524 include: signals and/or parameters to be coded and/or decoded such as speech and/or audio signals and bit stream representations of such signals; any signals/parameters resulting from the encoding and decoding of speech and/or audio signals; signals not related to speech and/or audio signals that are to be processed using the techniques described herein.

In this document, the terms "computer program medium," "computer program product" and "computer usable medium" are used to generally refer to media such as removable storage unit 515, removable storage unit 522, and a hard disk installed in hard disk drive 512. These computer program products are means for providing software to computer system 500.

Computer programs (also called computer control logic) are stored in main memory 505 and/or secondary memory 510. Also, decoded speech segments, filtered speech segments, filter parameters such as filter coefficients and gains, and so on, may all be stored in the above-mentioned memories. Computer programs may also be received via communications interface 524. Such computer programs, when executed, enable the computer system 500 to implement the present invention as discussed herein. In particular, the computer programs, when executed, enable the processor 504 to implement the processes of the present invention, such as the method illustrated in FIG. 4, for example. Accordingly, such computer programs represent controllers of the computer system 500. Where the invention is implemented using software, the software may be stored in a computer program product and loaded into computer system 500 using removable storage drive 514, hard drive 512 or communications interface 524.

In another embodiment, features of the invention are implemented primarily in hardware using, for example, hardware components such as application specific integrated circuits (ASICs) and gate arrays. Implementation of a hardware state machine so as to perform the functions described herein will also be apparent to persons skilled in the art.

D. Conclusion

While various embodiments of the present invention have been described above, it should be understood that they have been presented by way of example only, and not limitation. It will be understood by those skilled in the relevant art(s) that various changes in form and details may be made therein without departing from the spirit and scope of the invention as defined in the appended claims. For example, although the embodiments described above are described as filtering speech signals, the present invention is equally applicable to the filtering of audio signals generally, and in particular to audio signals exhibiting both periodic and non-periodic components. Accordingly, the breadth and scope of the present invention should not be limited by any of the above-described exemplary embodiments, but should be defined only in accordance with the following claims and their equivalents.

What is claimed is:

1. An encoder in a noise feedback coding system, comprising:

a first combiner that combines an input audio signal and a predicted audio signal to generate a prediction residual signal;

a second combiner that combines the prediction residual signal with a noise feedback signal to generate a quantizer input signal;

a quantizer that quantizes the quantizer input signal to generate a quantizer output signal;

a third combiner that combines the quantizer input signal and the quantizer output signal to generate a quantization error signal; and a noise feedback filter that filters the quantization error signal to generate the noise feedback signal, wherein the noise feedback filter is an all-zero filter configured to have a response substantially equal to that of a truncated finite impulse response of a pole-zero filter.

2. The encoder of claim 1, wherein the input audio signal comprises an input speech signal and wherein the predicted audio signal comprises a predicted speech signal.

3. The encoder of claim 1, wherein the noise feedback filter is a twelfth order filter.

4. The encoder of claim 1, wherein the quantizer is a vector quantizer.

5. The encoder of claim 1, further comprising:

a predictor that receives the input audio signal and generates the predicted audio signal therefrom.

6. The encoder of claim 5, wherein the predictor comprises a short-term predictor.

7. The encoder of claim 5, wherein $\hat{P}(z)$ is a transfer function of the predictor based on quantized predictor coefficients, $P(z)$ is a transfer function of the predictor based on non-quantized predictor coefficients, and the response of the noise feedback filter is defined as a finite impulse response truncation of $F(z)$, wherein $$F(z) = 1 - \frac{\hat{A}(z)A(z/\delta_1)}{A(z/\delta_2)},$$

$\hat{A}(z)=1-\hat{P}(z)$, $A(z)=1-P(z)$, and $\delta_1$ and $\delta_2$ are filter control parameters.

8. A method for encoding a signal in a noise feedback coding system, comprising:

combining an input audio signal and a predicted audio signal to generate a prediction residual signal;

combining the prediction residual signal with a noise feedback signal to generate a quantizer input signal;

quantizing the quantizer input signal to generate a quantizer output signal;

combining the quantizer input signal and the quantizer output signal to generate a quantization error signal; and filtering the quantization error signal to generate the noise feedback signal, wherein the filtering is performed using an all-zero filter configured to have a response that is defined as a truncated finite impulse response of a pole-zero filter.

9. The method of claim 8, wherein combining an input audio signal and a predicted audio signal comprises combining an input speech signal and a predicted speech signal.

10. The method of claim 8, wherein the filtering is performed using a twelfth order all-zero filter.

11. The method of claim 8, wherein quantizing the quantizer input signal comprises performing vector quantization of the quantizer input signal.

12. The method of claim 8, further comprising:

predicting the input audio signal to generate the predicted audio signal.

13. The method of claim 12, wherein predicting the input audio signal comprises performing short-term prediction of the input audio signal.

14. The method of claim 12, wherein:

predicting the input audio signal comprises predicting the input audio signal using a predictor, wherein $\hat{P}(z)$ is a transfer function of the predictor based on quantized predictor coefficients and $P(z)$ is a transfer function of the predictor based on non-quantized predictor coefficients; and filtering the quantization error signal comprises filtering the quantization error signal using an all-zero filter having a response that is defined as a finite impulse response truncation of $F(z)$, wherein $$F(z) = 1 - \frac{\hat{A}(z)A(z/\delta_1)}{A(z/\delta_2)},$$

$\hat{A}(z)=1-\hat{P}(z)$, $A(z)=1-P(z)$, and $\delta_1$ and $\delta_2$ are filter control parameters.

15. A computer program product comprising a computer useable medium having computer program logic recorded thereon for enabling a processor to encode a signal in a noise feedback coding system, comprising:

means for enabling the processor to combine an input audio signal and a predicted audio signal to generate a prediction residual signal;

means for enabling the processor to combine the prediction residual signal with a noise feedback signal to generate a quantizer input signal;

means for enabling the processor to quantize the quantizer input signal to generate a quantizer output signal;

means for enabling the processor to combine the quantizer input signal and the quantizer output signal to generate a quantization error signal; and means for enabling the processor to filter the quantization error signal to generate the noise feedback signal, wherein filtering the quantization error signal includes applying an all-zero filter that is configured to have a response that is defined as a truncated finite impulse response of a pole-zero filter.

16. The computer program product of claim 15, wherein the means for enabling the processor to combine an input audio signal and a predicted audio signal comprises means for enabling the processor to combine an input speech signal and a predicted speech signal.

17. The computer program product of claim 15, wherein filtering the quantization error signal comprises applying a twelfth order all-zero filter.

18. The computer program product of claim 15, wherein the means for enabling the processor to quantize the quantizer input signal comprises means for enabling the processor to perform vector quantization of the quantizer input signal.

19. The computer program product of claim 15, further comprising:

means for enabling the processor to predict the input audio signal to generate the predicted audio signal.

20. The computer program product of claim 19, wherein the means for enabling the processor to predict the input audio signal comprises means for enabling the processor to perform short-term prediction of the input audio signal.

21. The computer program product of claim 19, wherein:

the means for enabling the processor to predict the input audio signal comprises means for enabling the processor to predict the input audio signal using a predictor, wherein $\hat{P}(z)$ is a transfer function of the predictor based on quantized predictor coefficients and $P(z)$ is a transfer function of the predictor based on non-quantized predictor coefficients; and the means for enabling the processor to filter the quantization error signal comprises means for enabling the processor to filter the quantization error signal using an all-zero filter having a response that is defined as a finite impulse response truncation of $F(z)$, wherein $$F(z) = 1 - \frac{\hat{A}(z)A(z/\delta_1)}{A(z/\delta_2)},$$

$\hat{A}(z)=1-\hat{P}(z)$, $A(z)=1-P(z)$, and $\delta_1$ and $\delta_2$ are filter control parameters.

* * * * *